US007296684B2

(12) United States Patent
Gabl

(10) Patent No.: US 7,296,684 B2
(45) Date of Patent: Nov. 20, 2007

(54) SCREEN FOR CLEANING A FIBER SUSPENSION

(75) Inventor: Helmuth Gabl, Graz (AT)

(73) Assignee: Andritz AG, Graz (AT)

( * ) Notice: Subject to any disclaimer, the term of this patent is extended or adjusted under 35 U.S.C. 154(b) by 577 days.

(21) Appl. No.: 10/807,879

(22) Filed: Mar. 24, 2004

(65) Prior Publication Data

US 2004/0195168 A1 Oct. 7, 2004

(30) Foreign Application Priority Data

Mar. 27, 2003 (AT) ..... A 486/2003

(51) Int. Cl.
*B07B 1/20* (2006.01)

(52) U.S. Cl. ..... 209/273; 209/305

(58) Field of Classification Search ..... 209/273, 209/305, 306, 380, 389
See application file for complete search history.

(56) References Cited

U.S. PATENT DOCUMENTS

| | | | | |
|---|---|---|---|---|
| 4,268,381 | A * | 5/1981 | Hooper | 209/273 |
| 5,096,127 | A * | 3/1992 | Young | 241/46.17 |
| 5,119,953 | A * | 6/1992 | Atkeison et al. | 209/273 |
| 6,170,769 | B1 * | 1/2001 | Bergdahl et al. | 241/46.17 |
| 6,290,067 | B1 * | 9/2001 | Bergdahl et al. | 209/273 |
| 6,571,957 | B1 * | 6/2003 | Doelle et al. | 209/273 |

* cited by examiner

*Primary Examiner*—Joseph Rodriguez
(74) *Attorney, Agent, or Firm*—Alix, Yale & Ristas, LLP

(57) ABSTRACT

A screen, for cleaning a fiber suspension, includes at least one separating unit containing a housing, a parabolic rotor, a screen basket, an accept chamber, and a reject outlet. The reject outlet is located in the vicinity of the maximum rotor diameter. The screen also includes one or several devices for interrupting the axial flow located in the vicinity of the maximum rotor diameter.

19 Claims, 3 Drawing Sheets

SCREEN FOR CLEANING A FIBER SUSPENSION

BACKGROUND OF THE INVENTION

The invention relates to a screen for cleaning a fiber suspension.

Screens are machines used in the paper industry to clean a pulp suspension comprising water, fibers, and dirt particles. Here a feed flow runs through a screening device, where the accept flow, consisting of water and fibers, flows through the screen. A partial flow, known as the reject and consisting of water, fibers, and dirt particles, is generally removed at the opposite end to the feed flow. Thus, the solids particles present in the liquid are separated from one another in the screens. By contrast, in filtration processes the liquid is separated from the solids.

In general, a screen of this type is rotationally symmetrical and consists of a housing with a feed device mounted at a tangent, a cylindrical screen basket, normally with perforations or vertical slots, and a rotating rotor. The purpose of the rotor is to keep the screen slots clear, achieved by the vanes rotating close to the screen surface. The accept is collected in a so-called accept chamber, which often has a conical design, and drawn off from here in radial direction. The reject flow is generally brought to a reject chamber, which is usually annular, located at the opposite side of the screen basket to the inlet, and drawn off from here at a tangent.

A screen of this type is known, for example from U.S. Pat. No. 4,268,381.

Other screens known are described in, for example, EP 1 122 358 A2, EP 1 124 002 A2, and EP 1 124 003 A2.

In the screens according to EP 1 122 358 A2, EP 1 124 002 A2, and EP 1 124 003 A2, the following measures are implemented, particularly in order to improve flow conditions:

- An additional screen basket is provided in the feed area for pre-screening.
- In the feed area between the pipe socket and the freely accessible end of the rotor there is a stationary mounting, particularly a cone, truncated cone, hemisphere, spherical segment, spherical segment between two parallel circles, paraboloid, or a hyperboloid of two sheets.
- The accept chamber is designed as twin cones, widening in flow direction of the pulp suspension and tapering again from the mouth of the accept outlet in a conical shape towards the reject outlet.

In these known screens the rotor is designed for even flow onto the screen and is parabolic in shape so that the axial flow speed inside the screen basket remains constant at an assumed uniform flow through the screen basket. As an alternative, a cone shape can be used to come closer to the parabolic shape of the rotor.

It is also known that screens can be designed as multi-stage units, comprising several separation stages one after another.

The screens known from the state of the art, however, still hold disadvantages. In particular, the flow conditions at the reject outlet leave much to be desired.

SUMMARY OF THE INVENTION

The present invention provides a screen in which a further improvement can be attained in the flow conditions and thus, a reduction in the energy applied, while increasing production and dirt separation.

The screen according to the invention is characterised by the reject outlet being located in the vicinity of the maximum rotor diameter and by one or several devices to interrupt the axial flow being located in the vicinity of the maximum rotor diameter.

In the following, the term "devices" (plural) is used, relating also to screens according to the invention which have only one device to interrupt axial flow.

Depending on their origin and type (recycled fibers, fresh fibers, etc.), pulps contain differing amounts of dirt particles. To ensure stable screen operations, certain minimum amounts of carrier medium (reject amounts) must be set as a function of the dirt and flake content, and of the suspension's rheological characteristics.

It has proved favorable to mount devices to interrupt the axial flow at the same height as the maximum rotor diameter in order to guarantee stable screen operations.

The devices to interrupt axial flow can be mounted at the housing of the separation unit or at the screen basket and/or at the rotor of the screen. Thus, a design in which devices to interrupt the axial flow are provided on both sides (i.e. both at the housing and at the rotor) is also possible.

The devices should preferably be one or several axial flow interruption rings. Depending on its design, the flow interruption ring can either be continuous or in the form of individual segments, or have gaps.

The flow interruption ring (or flow interruption rings) can be of adjustable design, such that the size of the opening created by the flow interruption ring for the reject can be modified.

The flow interruption ring can be of adjustable design, for example in the same way as an iris diaphragm. In addition, the flow interruption ring can be adjustable statically (e.g. in the form of statically adjustable ring segments).

The outer diameter of a flow interruption ring on the rotor side preferably has a toothed profile.

A further preferred configuration of the screen according to the invention is characterised by at least one feed for dilution water being located in the vicinity of the reject outlet, particularly directly below it.

As a result, the reject leaving the screen is diluted with water. This dilution is favorable particularly in a multi-stage screen configuration where the reject from one stage is also the feed to the following stage.

One or more feed points can be provided for dilution water, which can be located at the housing of the separation unit or at the screen basket and/or at the rotor. If a feed for dilution water is located at the rotor, this feed is supplied preferably through a pipe mounted inside the rotor.

The feed point—if necessary, several—for dilution water can be oriented such that dilution water can enter in rotor running direction and/or in the opposite direction to rotation of the rotor.

Thus, the rotating movement of the pulp suspension can be reduced. By causing turbulence in the suspension, loosening of the suspension can be improved.

In a further preferred configuration of the screen according to the invention, at least one feed for dilution water is coupled to a device for interrupting the axial flow. For example, the feed of dilution water can protrude into the area between housing and rotor and thus, serve as a device for interrupting the axial flow.

Particularly in multi-stage screens, thickening of the suspension takes place on the one hand in the inflow area to the screen surface as the suspension flows between the first and the final screening stage, and on the other hand, the flake content becomes more concentrated.

In order to maintain the screening effect, the suspension consistency, as described above, is set by means of intermediate dilution. It has proved favorable to counteract this concentration of the flake content by inserting a deflaking unit.

Thus, the separating unit of the screen according to the invention should preferably contain a deflaking unit. Advantageously, the deflaker should take the form of one or several rings mounted on the housing or screen basket and/or on the rotor. The shape of the mountings used corresponds to models that are already known in themselves, while additional hydraulic guiding elements can be included in order to set differential pressures.

The screen according to the invention can preferably comprise two or more separation units located one after another in a manner already known, where all separation units have one common rotor, which has a parabolic or parabolic segment shape for each separation unit, adapted to the flow conditions in the separation unit in each case.

The height of each separation unit should preferably be at least twice the sum of the heights of all separation units adjoining the separation unit in question, i.e. in a screen with three separation units, the height of the first stage is at least ⅔ the overall height of the unit and the height of the second stage is at least ⅔ of the overall height.

Each separation unit of a multi-stage screen according to the invention should preferably contain one or more devices to interrupt the axial flow, as described above, in the vicinity of the maximum diameter.

Similarly, it is preferable to have at least one inlet for dilution water in each separation unit in the vicinity of the reject outlet or underneath it.

In a multi-stage screen, the feed for dilution water can be located in the lower delimitation of the rotor segment of a separation unit so that the dilution water is discharged into the space beneath the rotor segment (and thus into the vicinity of the reject outlet or the area below it). As an alternative or additionally, the feed for dilution water can be mounted in the upper part of the rotor segment of the following separation unit.

In a multi-stage screen according to the present invention with at least three separation units, a minimum of one deflaking unit should preferably be provided, particularly at the transition from the second to the third separation unit.

In addition to the features described above, the screen according to the invention should preferably contain one or several features of the screens described in EP 1 122 358 A2, EP 1 124 002 A2, and EP 1 124 003 A2.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
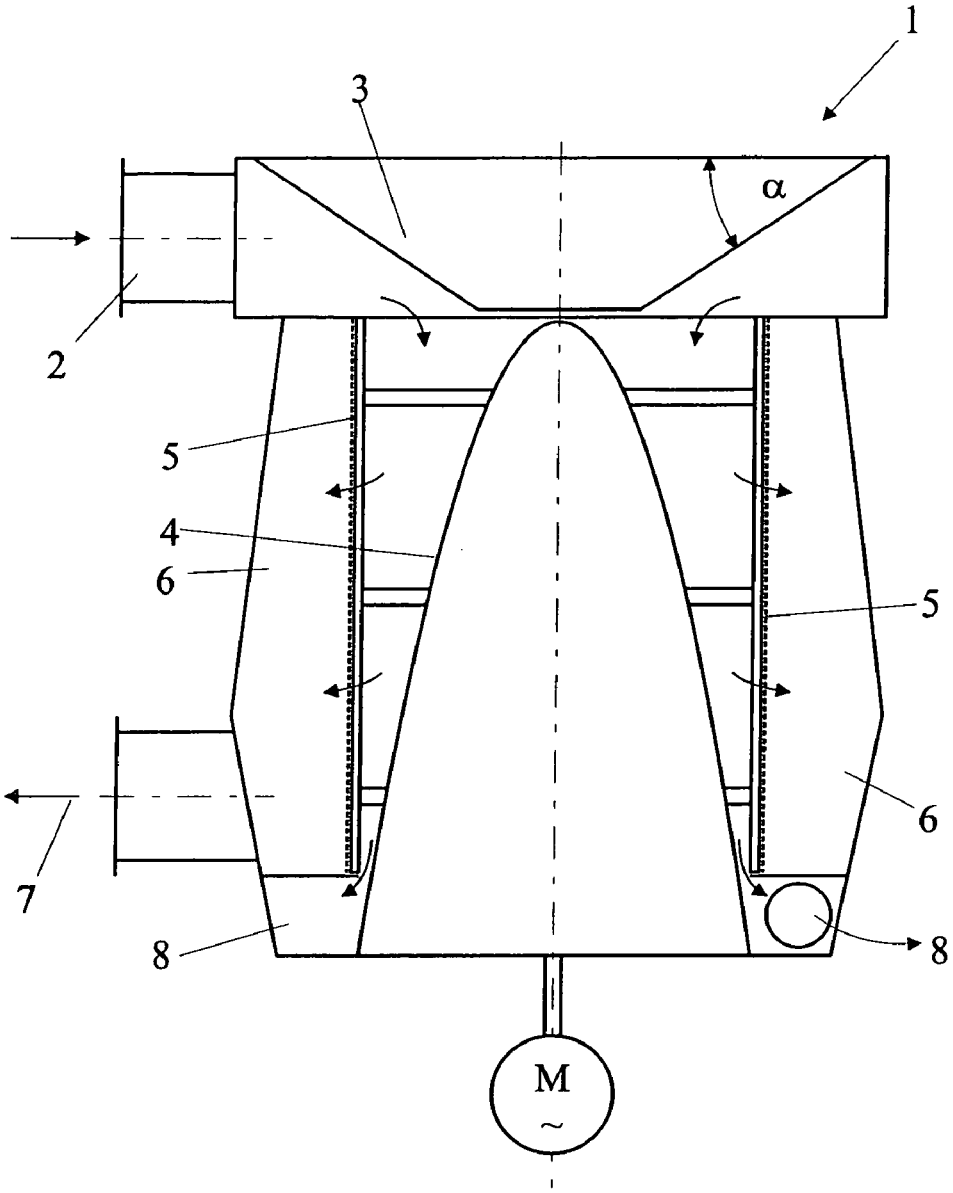
Fig. 1 Prior Art
FIG. 1 is a view of a conventional screen.

The screen according to FIG. 1 comprises, in a way already known, a feed branch 2, through which a pulp suspension if fed for cleaning purposes. In the feed area, a mounting 3 is provided, which is shown here as a truncated cone. The pulp suspension enters the space between the parabolic rotor 4 and the screen 5 and is conveyed through the screen into the accept chamber 6. The housing of the accept chamber is designed as a double cone in this configuration and in a way which is generally known. The accept outlet is marked with reference number 7. The reject is removed through a reject outlet 8.

Figure 2:
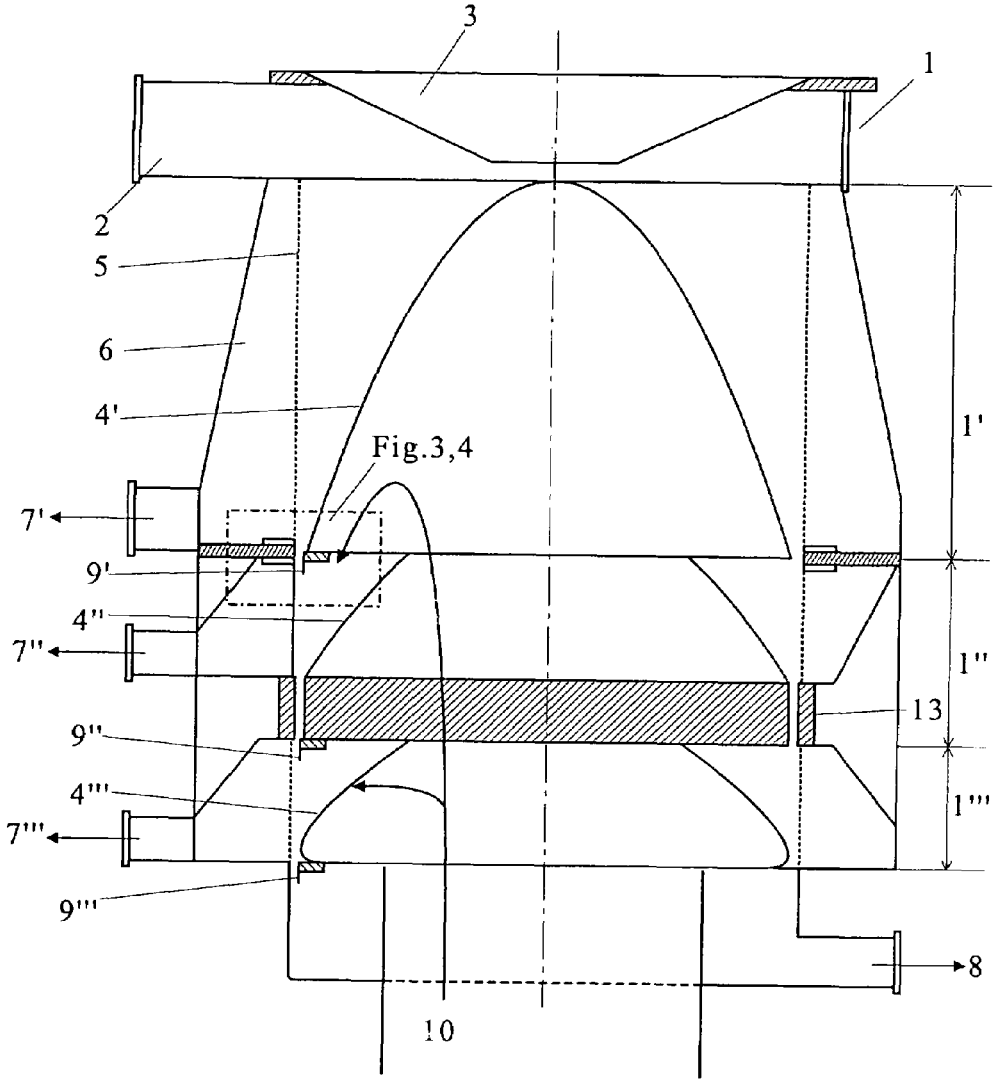
FIG. 2 is a view of a multi-stage screen according to a preferred configuration of the present invention.

In FIG. 2, those devices or parts of devices that are identical to the configuration which is state of the art and shown in FIG. 1 are marked with the same reference numbers. In the preferred configuration of a screen according to the invention and as shown in FIG. 2, the screen 1 consists of three separation units 1', 1" and 1'".

The three separation units 1', 1" and 1'" have one common rotor, whose sections 4', 4" and 4'", respectively, adapted to the flow conditions in the corresponding separation unit, are parabolic or have the shape of a truncated paraboloid. As an alternative, the sections of the rotor can also be shaped similar to a truncated cone or a parabola.

Each separation unit has a reject outlet (9', 9" and 9'"). The reject from the first and second separation units is thus also the feed to the next separation unit in each case. The reject from the third and final separation unit is drawn off through the reject outlet 8.

In FIG. 2, a pipe for dilution water mounted inside the rotor is marked 10 and the outlets from the pipe will be described in more detail below.

A deflaking unit 13 is provided at the transition from the second to the third separation unit.

Figure 3:
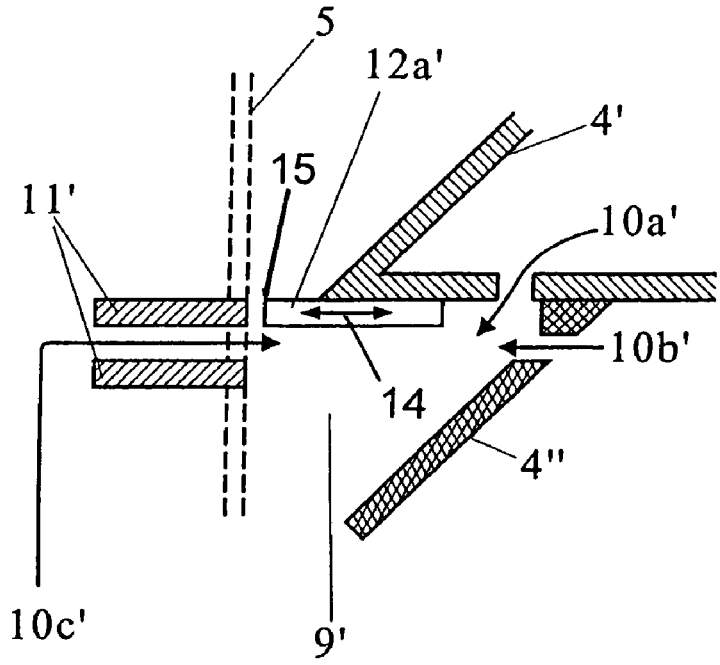
FIG. 3 is an enlarged section of a reject outlet from the screen according to FIG. 2.
Figure 4:
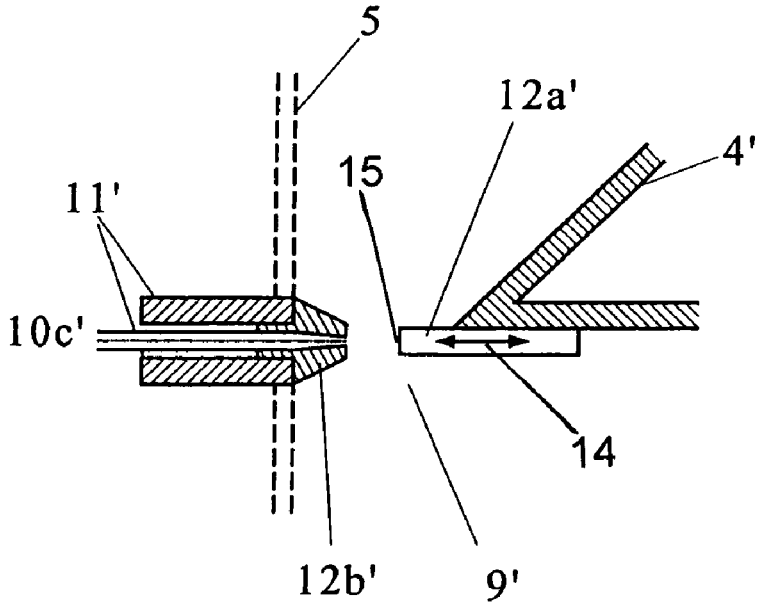
FIG. 4 is an enlarged section of an alternative design of a reject outlet.

FIGS. 3 and 4 show preferred configurations of a reject outlet (in this case reject outlet 9') in an enlargement of the section marked with a chain-dot line in FIG. 2.

According to the configuration shown in FIG. 3, an adjusting ring 12*a'* is mounted at the lower end of the rotor section 4'. The adjusting ring can have an adjustable mounting, as explained above, e.g. in the shape of an iris diaphragm 14 (indicated by the double arrow). The outer diameter of the adjusting ring or its segments should preferably have a toothed profile 15.

With the adjustable ring 12*a'*, the axial throughput can be controlled by means of the reject outlet 9'.

Furthermore, in the configuration according to FIG. 3, feed points for dilution water 10*a'*, 10*b'*, and 10*c'* are provided on the housing, as well as at rotor sections 4' and 4" in the vicinity of the reject outlet 9' and beneath it.

The feed point 10*a'* is located in the lower delimitation of the rotor segment 4' of the first separation unit 1'. The feed point 10*b'* is placed in the upper section of the rotor segment 4" of the second separation unit 1". The feed points 10*a'* and 10*b'* can be supplied through a pipe 10 (see FIG. 2) mounted inside the rotor.

The feed point 10*c'*, for example, is located in the vicinity of a flange 11 between the first separation unit 1' and the second separation unit 1" and is supplied through a pipe not shown in this illustration.

With the feed pipes for dilution water 10*a'*, 10*b'* and 10*c'*, the consistency of the pulp suspension flowing to the next separation unit can be controlled effectively.

The configuration of the reject outlet 9' shown in FIG. 4 differs from the configuration shown in FIG. 3 in that a flow interruption ring 12*b'* is mounted on the housing in addition to the adjusting ring 12*a'*. The housing side feed 10*c'* for dilution water is also located in the flow interruption ring 12*b'*, i.e. the feed for dilution water and the flow interruption ring are coupled to one another. Of course, the configuration in FIG. 4 can also include additional feed lines for dilution water at the rotor, as shown in FIG. 3.

The height of each separation unit should preferably be at least twice the sum of the heights of all separation units adjoining the separation unit in question, i.e. in a screen with three separation units, 1', 1", 1''', the height of the first stage 1' is at least ⅔ the overall height of the unit and the height of the second stage 1" is at least ⅔ of the overall height.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A screen for cleaning a fiber suspension, the screen comprising:

a housing;

a rotor disposed within the housing;

a screen basket disposed between the housing and the rotor, the screen basket defining a plurality of separation units, the rotor extending axially through all of the separation units, the rotor including a rotor segment disposed within each of the separation units, each rotor segment extending axially from an area of minimum rotor diameter to an area of maximum rotor diameter and defining a substantially parabolic shape adapted to the flow conditions in the associated separation unit;

an accept chamber disposed between the screen basket and the housing;

a reject outlet disposed adjacent the area of maximum rotor diameter of at least one of the rotor segments; and at least one device for interrupting axial flow disposed adjacent the area of maximum rotor diameter of one of the rotor segments, the at least one device for interrupting axial flow comprising at least one axial flow interruption ring.

2. The screen of claim 1 wherein the at least one device for interrupting axial flow is mounted to the rotor.

3. The screen of claim 1 wherein the at least one flow interruption ring is adjustable.

4. The screen of claim 3 wherein the at least one flow interruption ring is an iris diaphragm.

5. The screen of claim 1 wherein the at least one flow interruption ring includes an outer diameter having a toothed profile.

6. The screen of claim 1 wherein at least one separation unit further comprises at least one inlet for dilution water, the at least one inlet being located adjacent the reject outlet.

7. The screen of claim 6 wherein the at least one inlet is mounted on the housing or on the screen basket.

8. The screen of claim 6 wherein the at least one inlet is mounted on the rotor and fed through a pipe mounted inside the rotor.

9. The screen of claim 6 wherein the at least one inlet is directed such that the dilution water is fed in the running direction of the rotor.

10. The screen of claim 6 wherein the at least one inlet is directed such that the dilution water is fed in an opposite direction to the running direction of the rotor.

11. The screen of claim 1 wherein at least one separation unit further comprises a deflaking unit.

12. The screen of claim 11 wherein the deflaking unit includes at least one ring mounted on the housing, on the screen basket, or on the rotor.

13. The screen of claim 1 wherein each separation unit has a height and the height of a one of the separation units is at least twice the sum of the heights of all of the separation units axially below the one separation unit.

14. The screen of claim 1 wherein each separation unit includes at least one device for interrupting axial flow.

15. The screen of claim 1 wherein each separation unit further comprises at least one inlet for dilution water, the at least one inlet being located adjacent the reject outlet.

16. The screen of claim 1 further comprising a deflaking unit.

17. The screen of claim 16 wherein the screen has first, second and third separation units and the deflaking unit is disposed intermediate the second and third separation units.

18. A screen screen for cleaning a fiber suspension, the screen comprising:

a housing;

a rotor disposed within the housing;

a screen basket disposed between the housing and the rotor, the screen basket defining a plurality of separation units, the rotor extending axially through all of the separation units, the rotor including a rotor segment disposed within each of the separation units, each rotor segment extending axially from an area of minimum rotor diameter to an area of maximum rotor diameter and defining a substantially parabolic shape adapted to the flow conditions in the associated separation unit;

an accent chamber disposed between the screen basket and the housing;

a reject outlet disposed adjacent the area of maximum rotor diameter of at least one of the rotor segments; and at least one device for interrupting axial flow disposed adjacent the area of maximum rotor diameter of one of the rotor segments;

wherein the at least one device for interrupting axial flow is mounted to the housing or to the screen basket.

19. A screen for cleaning a fiber suspension, the screen comprising:

a housing;

a rotor disposed within the housing;

a screen basket disposed between the housing and the rotor, the screen basket defining a plurality of separation units, the rotor extending axially through all of the separation units, the rotor including a rotor segment disposed within each of the separation units, each rotor segment extending axially from an area of minimum rotor diameter to an area of maximum rotor diameter and defining a substantially parabolic shape adapted to the flow conditions in the associated separation unit, at least one separation unit further comprising at least one inlet for dilution water, the at least one inlet being located adjacent the reject outlet and being coupled to the at least one device for interrupting axial flows;

an accept chamber disposed between the screen basket and the housing;

a reject outlet disposed adjacent the area of maximum rotor diameter of at least one of the rotor segments; and at least one device for interrupting axial flow disposed adjacent the area of maximum rotor diameter of one of the rotor segments.

* * * * *